United States Patent [19]

Brandenberg et al.

[11] 4,351,225

[45] Sep. 28, 1982

[54] VIBRATION ATTENUATION CONSTRUCTION FOR AN IMPACT AIR TOOL

[75] Inventors: Karl A. Brandenberg, Chehalis, Wash.; Wilbert G. Kautz, Bryan, Ohio

[73] Assignee: The Aro Corporation, Bryan, Ohio

[21] Appl. No.: 112,864

[22] Filed: Jan. 17, 1980

[51] Int. Cl.[3] ..... F01L 21/02; F01B 15/02

[52] U.S. Cl. ..... 91/50; 91/217; 91/325

[58] Field of Search ..... 91/50, 217, 325, 402

[56] References Cited

U.S. PATENT DOCUMENTS

| | | | |
|---|---|---|---|
| 3,034,302 | 5/1962 | Akermon | 74/583 |
| 3,236,157 | 2/1966 | Lovell et al. | 91/50 |
| 3,703,848 | 11/1972 | Brown | 91/325 |
| 3,881,399 | 5/1975 | Sagi et al. | 91/325 |
| 4,117,764 | 10/1978 | Nilsson | 91/50 |

FOREIGN PATENT DOCUMENTS 2612218 4/1979 Fed. Rep. of Germany .

*Primary Examiner*—Paul E. Maslousky

*Attorney, Agent, or Firm*—Allegretti, Newitt, Witcoff & McAndrews

[57] ABSTRACT

A vibration and noise attenuating construction for impact air tools, such as a chipper, includes axially reciprocal working and balancing members which move toward and away from each other. The end of one member defines a cylinder and cylinder chamber which receives a piston defined in the end of the other member. Pressurized air is introduced into the cylinder chamber causing the chamber to expand and the members to be translated axially from each other against the force of compression springs. Translation of the piston beyond an exhaust passage in the cylinder wall permits the chamber to exhaust whereupon the compression springs will drive the members toward their original position. The members constantly cycle in this manner to provide vibration attenuation.

9 Claims, 5 Drawing Figures

VIBRATION ATTENUATION CONSTRUCTION FOR AN IMPACT AIR TOOL

BACKGROUND OF THE INVENTION

The present invention relates to an improved vibration attenuation and noise attenuation construction for a reciprocating mass, pneumatically driven tool.

Nilsson, et al, in U.S. Pat. No. 4,088,062, discloses a fluid pressure operated impact mechanism which includes a reciprocating work member cooperative with an O-ring seal to thereby define a chamber. Pressurizing fluid is admitted to the chamber causing the chamber to expand and break the seal thereby transporting the impact member.

Nilsson, et al, in U.S. Pat. No. 4,117,764, discloses an improvement over the mechanism of U.S. Pat. No. 4,088,062. The Nilsson '764 patent discloses a two mass balanced system wherein vibration is attenuated in an impact tool by maintaining opposed axially movable members, one of which is a working member and the second of which is a balancing member. A similar structure is shown in British Pat. No. 431,317.

The Nilsson, et al U.S. Pat. No. 4,117,764 further discloses that the working member and balancing member are separated by an O-ring to thereby define a chamber between the members. The O-ring seals the members and is expandable once pressurized fluid is admitted to the chamber between the two members. Expansion of the chamber beyond a predetermined limit breaks the O-ring seal and causes fluid within the chamber to exhaust. Subsequently, the members reform the chamber in combination with the O-ring. The described device provides good vibration attenuation characteristics.

The present invention constitutes an improvement over the device shown in the Nilsson '764 patent. Among the improved features of the present invention is the elimination of parts, the capability of longer life, an arrangement which will permit frequency adjustment and fine tuning of the vibration characteristics of the device, and lower cost associated with the manufacture of the device.

SUMMARY OF THE INVENTION

Briefly, the present invention includes a housing with a working member and balancing member mounted in opposed relationship for reciprocal, axial movement in the housing. Means such as air springs or mechanical springs are provided to bias the members toward each other. The members define a cooperating piston, cylinder, and cylinder chamber. Pressurized fluid is admitted to the chamber causing translation of the piston within the cylinder to an extended position whereupon an opening or passage in the cylinder wall permits exhaustion of the chamber. The piston and cylinder than are driven toward each other. This operation continues in a cyclical fashion.

The position of the passage in the cylinder wall may be adjusted to control the frequency and vibration of the device. A piston ring cooperative with the internal cylinder wall is preferably a metal piston ring which has longer life than an elastomeric O-ring type seal. In this manner O-ring seals are eliminated and the useful life of the tool is increased. Simultaneously, the vibration as well as the noise associated with the tool is attenuated.

Thus, it is an object of the present invention to provide an improved vibration and noise attenuation construction for an air tool.

A further object of the present invention is to provide a balanced mass, vibration attenuation system for an air tool such as a chipper or the like.

Still another object of the present invention is to provide an improved air tool construction including opposed balanced masses defining a cooperating piston and cylinder which act to attenuate vibration.

Still a further object of the present invention is to provide an improved vibration attenuation system for an air tool which is inexpensive to manufacture, has extended life and lends itself to easy repair.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
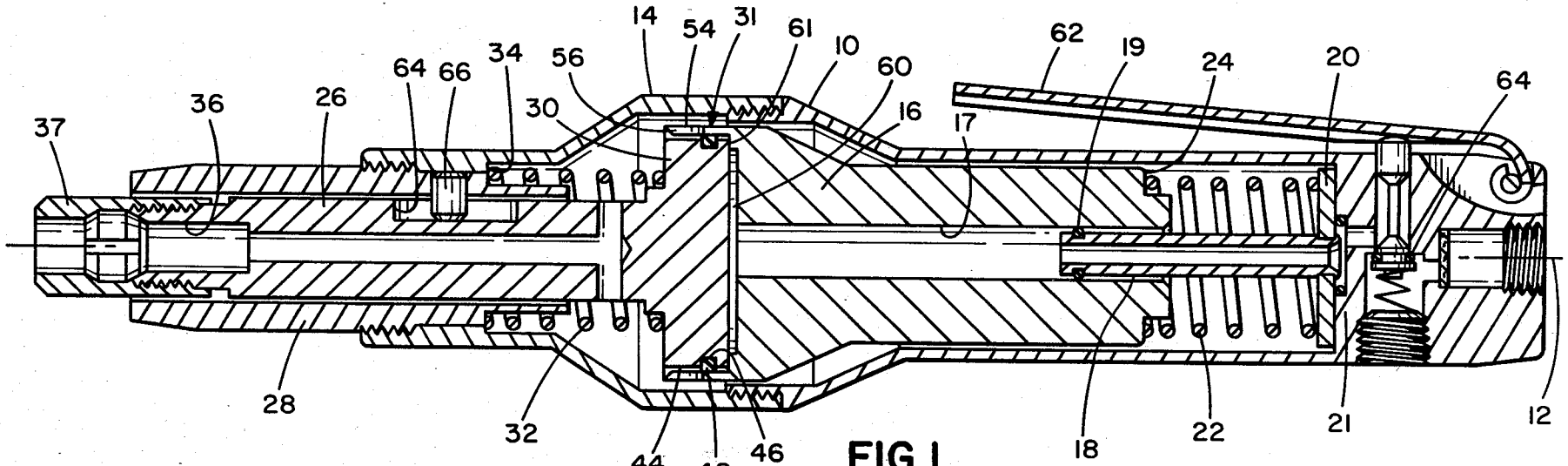
FIG. 1 is a side cross sectional view of the improved construction of the present invention as incorporated in a typical pneumatically driven chipper.
Figure 2:
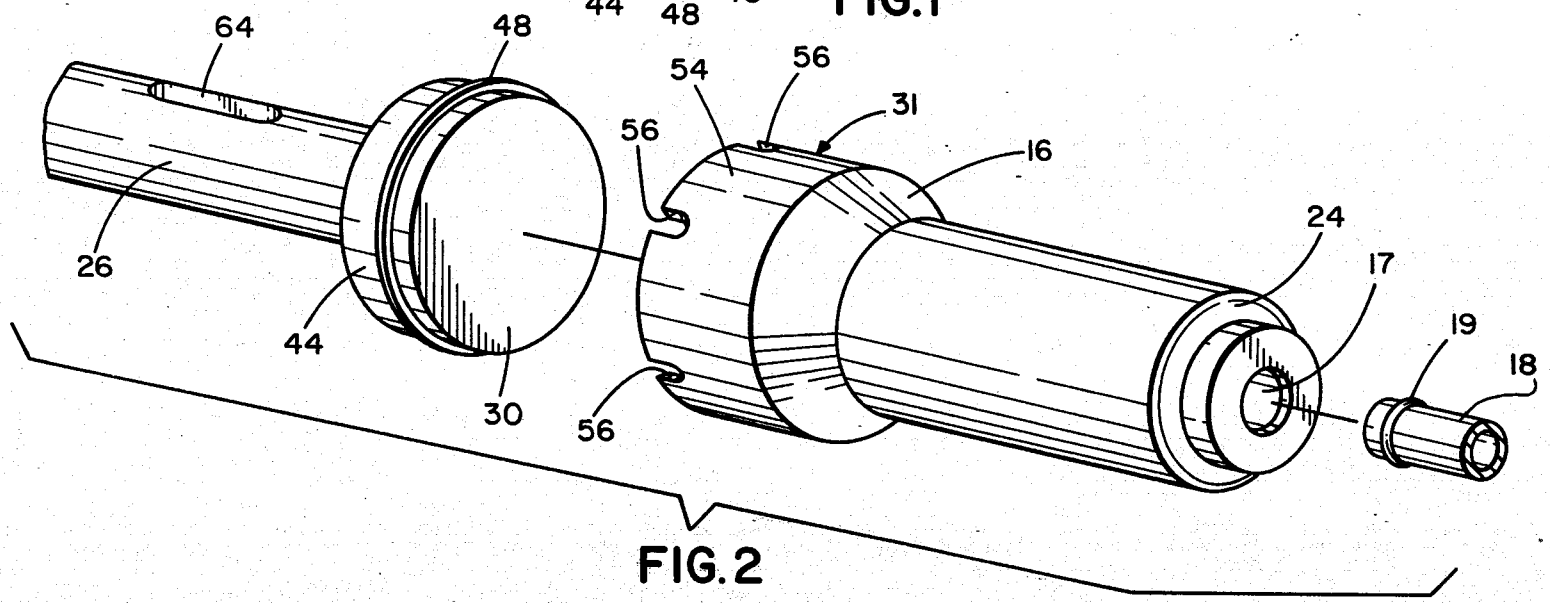
FIG. 2 is an exploded perspective view of the piston and cylinder arrangement for the improved construction of the present invention.

Referring to the drawing, the invention is depicted as being incorporated in an air driven chipper. However, the invention may be incorporated in any fluid driven tool which requires an axial impact driving force.

Figure 4:
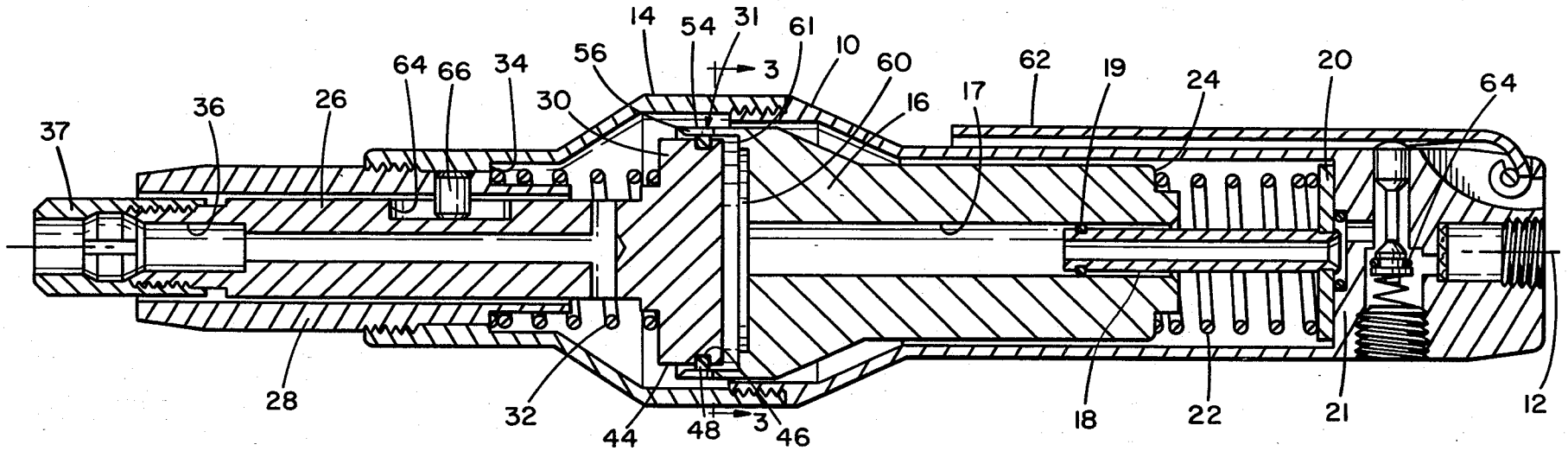
FIG. 4 is a cross sectional view of the tool of the present invention similar to FIG. 1 wherein the working member and balancing member associated with the tool have been moved to an extended, expanded, axial position.

The chipper includes a main housing 10. The main housing 10 is generally cylindrical and, as shown in FIGS. 1 and 4, is symmetrical about a center line axis 12. The main housing 10 is cooperative with a front housing 14 which maintains the cooperating internal elements of the chipper within the main and front housing 10 and 14.

A cylindrical balancing member 16 with an axial passage 17 is slidably mounted on a hollow shaft or conduit 18. The shaft 18 is fixed to a washer or bushing 20 which is retained against end flange 21 of housing 10. A piston ring seal 19 is fitted into a ring slot on the shaft 18. Thus, the balancing member 16 may ride freely on the shaft 18 and the passage 17 is sealingly connected with the hollow shaft 18. A spring 22 is interposed between the end 24 of the member 16 and the washer 20. Spring 22 biases the balancing member 16 axially away from the bushing 20 and flange 21.

Arranged in opposed relationship to the balancing member 16 is a working member 26. Working member 26 is mounted for axial slidable movement in bushing 28. Working member 26 includes a head or piston 30 which cooperates with a spring 32 interposed between piston 30 and the annular recess 34 defined between housing 14 and bushing 28. In this manner, the working member 26 is continuously biased in an axial direction toward the balancing member 16. A tool such as a chipper bit (not shown) may be inserted in the open end 36 of the working member 26 for retention by collet 37.

The particular structure of the present invention relates to the unique configuration and arrangement of an interengaging piston 30 and a cylinder 31 associated respectively with the working member 26 and balancing member 16. Referring to the FIGURES, a piston 30 includes a piston ring slot 46 defined in its outer surface 44. A metal or composition piston ring 48 is retained within the slot 46.

The cylinder 31 is defined at the end of balancing member 16 by cylindrical wall 54. Piston 31 fits within wall 54. The wall 54 may be integrally formed with the balancing member 16 or may be threadably attached to the balancing member 16 to provide for adjustment.

The wall 54 includes a plurality of slots 56 which are generally parallel to the axis 12 and disposed in a radial pattern about the axis 12 in the wall 54. The piston 30 and cylinder wall 54 define an enclosed chamber 60. Travel of piston 30 is limited by the flange 61, as shown in FIG. 1 when the springs 22 and 32 act to translate the members 16 and 26 toward each other.

Figure 5:
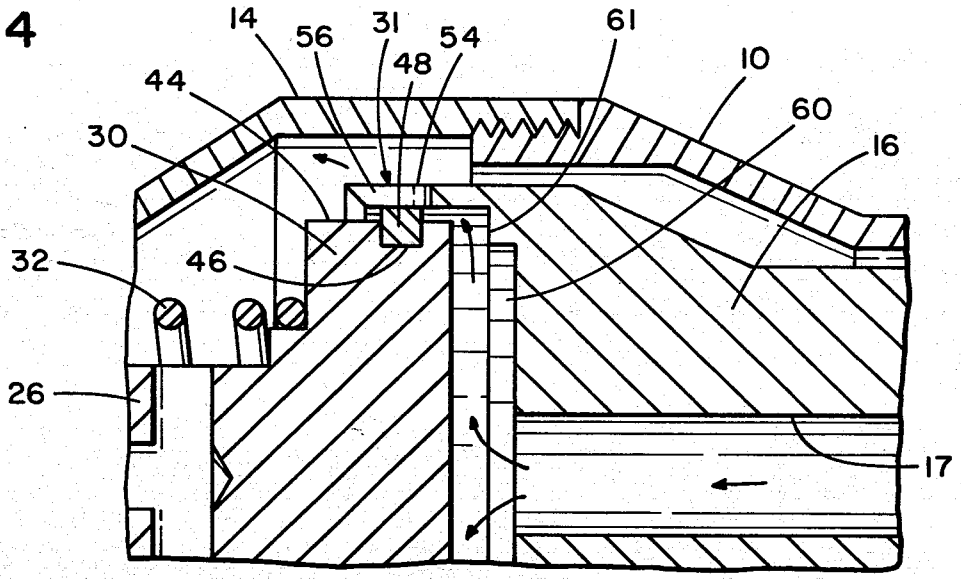
FIG. 5 is an enlarged partial cross sectional view of the piston and cylinder arrangement associated with the tool as shown in FIG. 4.
Figure 3:
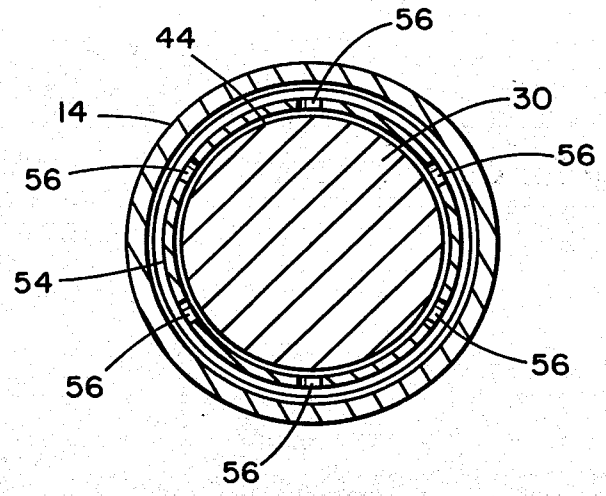
FIG. 3 is a cross sectional view of the tool of FIG. 1 taken substantially along the line 3—3.

Depressing the lever 62 associated with the air inlet valve 64 opens the valve 64 as shown in FIG. 4 permitting pressurized air to flow through the conduit 17 and shaft 18. This pressurized air enters the chamber 60 causing the chamber 60 to become pressurized. This causes the members 16 and 26 to separate. Simultaneously the piston 30 slides along the interior of cylinder wall 54 and ultimately slides to the position shown in FIG. 5. When in this position, air from the chamber 60 escapes through the slots 56 to the atmosphere. The exhausting of pressurized air from the chamber 60 permits the springs 22 and 32 to drive the members 16 and 26 back toward their original position shown in FIG. 1.

The members 16 and 26 thus reciprocate in a cyclical manner along the axis 12 between the positions shown in FIGS. 1 and 4. The amount of travel and thus the frequency of vibration of the device may be controlled by adjusting the relative position of the cylinder wall 54 on the member 16. Other adjustments may be effected by controlling the size of the slots 56. It is noted that the piston 30 includes a slot 64 cooperative with a stud 66 projecting from bushing 28. This stud 66 prevents rotation of member 26 in bushing 28.

It is possible to eliminate one or both springs 22 and 32 by providing an air spring in place thereof. Various other changes to the structure of the device may be made without departing from the scope of the invention. The invention, therefore, is to be limited only by the following claims and their equivalents.

What is claimed is:

1. A vibration and noise attenuation construction in a fluid driven tool comprising, in combination:

a housing;

a working member and a balancing member mounted in opposed relation, both members being mounted for reciprocal movement in the housing toward and away from each other;

means for continuously imparting a force on both the working member and the balancing member to drive the members toward one another;

one of said working member and said balancing member defining a piston and the other of said working member and said balancing member defining a cylinder having a cylinder wall for slidable receipt of the piston, said piston being mounted for reciprocal movement in the cylinder, said piston and cylinder defining a closed cylinder chamber;

means for continuously directing pressurized fluid into the cylinder chamber;

and passage means through the cylinder wall for exhausting the chamber upon the expansion of the chamber beyond a predetermined extent, said working member and balancing member moving in a cyclical manner first by expanding the chamber as pressurized fluid is admitted to the chamber to cause the members to translate apart to increase the volume of the chamber and connect the chamber through the passage means to the outside of the chamber to thereby permit exhaustion of the chamber and reduction of pressure in the chamber, and thereafter by contracting the chamber as the members translate in the reverse direction toward one another due to the reduced pressure in the chamber, said reverse direction movement closing the passage means and permitting the fluid in the chamber to define a means for damping the movement of the piston and cylinder toward each other.

2. The improved construction of claim 1 wherein said piston and said cylinder include cooperating lands which limit the travel of the piston and the cylinder toward each other.

3. The improved construction of claim 1 wherein said piston includes a circumferential piston ring for engaging the cylinder wall and sealing the ring to the wall.

4. The improved construction of claim 3 wherein said piston ring comprises a metal piston ring.

5. The improved construction of claim 1 wherein said passage means comprise a plurality of longitudinal slots in the cylinder wall parallel to the axis of movement of the members.

6. The improved construction of claim 1 wherein the means for directing pressurized fluid into the chamber comprises a hollow shaft extending at least partially axially through one of the members, said shaft connected at one end to a pressurized fluid source and to its opposite end to the chamber.

7. The construction of claim 6 wherein said shaft comprises a mounting rod for one of the members for slidable, axial movement on the rod.

8. The improved construction of claim 1 including at least one mechanical spring comprising means for continuously imparting an axial force on one of the members.

9. The improved construction of claim 1 wherein said means for imparting a force includes a separate mechanical spring biased against each member for imparting the force on each of the members.

* * * * *